US006533542B2

(12) United States Patent
Sugishita et al.

(10) Patent No.: US 6,533,542 B2
(45) Date of Patent: Mar. 18, 2003

(54) SPLIT RING FOR GAS TURBINE CASING

(75) Inventors: Hideaki Sugishita, Takasago (JP); Hisato Arimura, Takasago (JP); Yasuoki Tomita, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/043,201

(22) Filed: Jan. 14, 2002

(65) Prior Publication Data

US 2002/0094268 A1 Jul. 18, 2002

(30) Foreign Application Priority Data

Jan. 15, 2001 (JP) ..... 2001-006451

(51) Int. Cl.[7] ..... F01D 11/08
(52) U.S. Cl. ..... 415/139; 415/173.1; 415/178
(58) Field of Search ..... 415/138, 139, 415/173.1, 177, 178

(56) References Cited

U.S. PATENT DOCUMENTS 3,841,787 A * 10/1974 Scalzo ..... 415/138
3,892,497 A * 7/1975 Gunderlock et al. ..... 415/139
5,374,161 A * 12/1994 Kelch et al. ..... 415/139
6,270,311 B1 * 8/2001 Kuwabara et al. ..... 415/139

FOREIGN PATENT DOCUMENTS

JP 2000-257447 9/2000

* cited by examiner

*Primary Examiner*—Christopher Verdier
(74) *Attorney, Agent, or Firm*—Oblon, Spivak, McClelland, Maier & Neustadt, P.C.

(57) ABSTRACT

A split ring is disposed on an inner wall of a gas turbine casing. The split ring is composed of a plurality of split segments that are arranged on the inner wall of the casing in circumferential direction. A predetermined clearance is formed between the inner face of a split segment and the rotor blade tips. The split segments are arranged so that a predetermined circumferential clearance is formed between the split segments in order to allow the thermal expansion of the segments. A circumferential end face located upstream side of the segments with respect to the direction of the rotor blade rotation is connected to the inner face by a transition face having a surface formed as an inclined plane. The inclined plane prevents the swirl flow caused by the rotating rotor blade from impinging the upstream end face and, thereby, suppresses a temperature rise of the split segment at the upstream end face.

6 Claims, 5 Drawing Sheets

SPLIT RING FOR GAS TURBINE CASING

BACKGROUND OF THE INVENTION

1. Field of the Invention

The present invention relates to a combustion gas turbine and, specifically, it relates to a split ring disposed on the inner wall surface of a gas turbine casing.

2. Description of the Related Art

A turbine casing of a combustion gas turbine forms a hot gas path through which high temperature combustion gas passes. Therefore, a lining made of a heat resistant material (such as a thermal protection tile) is disposed on the inner wall surface in order to prevent the casing metal surface from directly contacting hot combustion gas. Usually, the thermal protection lining is composed of a plurality of split segments arranged on the inner surface of the turbine casing in a circumferential direction so that the segments form a ring. Therefore, the thermal protection lining of the turbine casing is often called "a split ring". In order to avoid problems due to thermal expansion at a high temperature, the respective split segments are spaced apart from each other in a circumferential direction.

FIG. 1 shows a cross-section of a turbine casing taken along the center axis thereof which indicates the position of the split ring.

In FIG. 1, numeral 1 designates a turbine casing as a whole. The turbine casing 1 has a cylindrical form in which a plurality of annular casing segments 3 made of metal are joined to each other in the axial direction.

Each casing segment is provided with a thermal insulation ring 5 disposed inside the casing segment 3 and spaced apart from the inner surface of the casing segment 3. Stator blades 9 of the respective turbine stages are fixed to the thermal insulation ring 5 through a stator ring 7.

Further, a split ring 10 is attached to the inner surface of each thermal insulation ring 5 at the portion between the stator rings 7 in such a manner that the inner surface of the split ring 10 opposes the tips of the rotor blades 8 with a predetermined clearance therebetween.

The split ring 10 is, as explained before, composed of a plurality of split segments made of a heat resistant material and arranged in the circumferencial direction of the casing inner wall. The respective split segments are spaced apart, in the circumferential direction, at a predetermined distance in order to accommodate the thermal expansion of the split segments.

A split ring of this type is disclosed in, for example, Japanese Unexamined Patent Publication (Kokai) No. 2000-257447.

The split segment of the split ring in the '447 publication is provided with an internal cooling air passage for cooling the split segment. Cooling air after cooling the split segment is injected from the outlet of the passage disposed on the end face of the split segment located on the downstream side thereof with respect to the direction of the rotation of the turbine rotor. The cooling air is injected from the above-noted outlet obliquely toward the end face of the adjacent split segment. Further, the comer between the end face located upstream side with respect to the direction of rotation of the rotor and the inner face of the split segment in the '447 publication is cut off so that the cooling air—injected from the adjacent split segment flows along the inclined surface formed at the comer. Thus, the inclined surface between the end face and the inner face is cooled by the film of cooling air.

However, in the split ring composed of the split segments, heat load exerted on the corner of the split segment between the upstream end face and inner surface thereof is very high and, in some case, cooling by the cooling air film is not sufficient.

This problem will be explained with reference to FIG. 9.

FIG. 9 schematically illustrates a cross-section of the turbine casing perpendicular to its axis.

In FIG. 9, numeral 1 designates a turbine casing (more precisely, a thermal insulation ring), 11 designates split segments of the split ring 10. As explained before, the respective split segments 10 are arranged in the circumferential direction with relatively small clearance 13 therebetween. The rotor blades 8 rotate in the direction indicated by the arrow R with a small clearance between the inner face 11*c* of the split segments 11 and the tips of the rotor blades 8.

High temperature combustion gas flows through the casing 1 in the axial direction as a whole. However, when combustion gas passes through the rotor blades 8, a circumferential velocity component is given to combustion gas by the rotor blade rotation and combustion gas flows in the circumferential direction with a velocity substantially the same as the tip velocity of rotor blades in the clearance between the tips of the blades 8 and the split segment 11.

When this swirl flow of combustion gas passes the clearance 13 between the split segments 11, turbulence occurs in the swirl flow.

FIG. 10 schematically illustrates the behavior of the swirl flow FR of combustion gas when it passes the rotor blade 8. As shown in FIG. 10, when the swirl flow FR passes through the clearance 13 between the split segments 11, the swirl flow FR impinges on the lower portion (i.e., the portion near the corner between the end face and the inner face) of the upstream end faces lla of the split segment 11 before it flows into the clearance 13. Therefore, at the portion where swirl flow FR of combustion gas impinges on the upstream end face 11*a,* heat is transferred from combustion gas to the end face by an impingement heat transfer. This causes the heat transfer rate between the end face 11*a* and combustion gas flow FR to increase largely compared with the case where combustion gas flows along the inner face 11*c* of the split segments 11.

Due to this increase in the heat transfer rate, the lower portion of the upstream end face 11*a* (i.e., the portion near the corner between the upstream end face 11*a* and the inner face 11*c*) of the split segment 11 receives a large quantity of heat every time the rotor blade 8 passes the clearance 13. Therefore, the temperature of the corner portion of the upstream end faces 11*a* of the split segments 11 largely increases and, due to sharp increase in the local temperature, burning or cracking occurs at the corner portions of the split segments 11.

In the above-noted '447 publication, since cooling air is injected and flows along the corner portion of the split segment, the temperature rise of the corner portion is suppressed to some extent. However, in the actual operation, since the flow of cooling air is disturbed by the impinging swirl flow of combustion gas, a cooling air film sufficient for cooling the corner portion is not formed and, thereby, cooling of the corner portion is insufficient even if the cooling air is supplied to the corner portion as disclosed by '447 publication.

SUMMARY OF THE INVENTION

In view of the problems in the related art as set forth above, the objects of the present invention is to provide a split ring of a gas turbine casing capable of preventing the burning of the corner portion of the split segment by reducing the temperature rise caused by the impingement of the swirl flow of combustion gas.

The objects as set forth above is achieved by a split ring for a gas turbine casing, according to the present invention, comprising a plurality of split segments arranged on an inner wall of a gas turbine casing in a circumferential direction at predetermined intervals so that the split segments form a ring disposed between tips of turbine rotors and inner wall casing opposing the tips of the rotor blades, wherein each of the split segments includes two circumferential end faces which oppose the end faces of the adjacent split segments and an inner face substantially perpendicular to the end faces and opposing the tips of the rotors and a transition face formed between at least one of the end faces and the inner face and, wherein the surface of the transition face is formed in such a manner that the clearance between the tips of the rotor blades and the surface of the transition face increases from the inner face toward the end face.

According to the present invention, at least one of the end faces of the split segment is connected to the inner face by a transition face.

When the transition face is formed between the upstream end face and the inner face, the swirl flow of combustion gas flows along the transition face and does not impinge the end face. Therefore, an increase in the heat transfer rate on the end face does not occur.

When the transition face is formed between the downstream end face and the inner face, as the cross-section of the flow path of the swirl flow (i.e. the clearance between the tips of the rotor blades and the transition face) increases as it approaches the downstream end face. Therefore, the circumferential velocity of the swirl flow decreases near the downstream end face due to diversion of the flow passage. Thus, when the rotor blade passes the clearance between the split segments, though the swirl flow still impinges the upstream end face of the split segments, the velocity of the swirl flow when it impinges the end face is largely reduced and the increase in the heat rate due to impingement is suppressed.

As explained above, the transition face can be disposed either between the upstream end face and the inner face or between the downstream end face and the inner face. Further, the transition face can be disposed between inner face and both of the end faces.

The surface of the transient face can be any shape as long as the clearance between the rotor blade tip and the transition face increases from the end face toward the inner face. The transition face may be formed as a plane oblique to inner face and the end face. Further, the transition face may be formed as a cylindrical surface or a spherical surface.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

Hereinafter, embodiments of the split ring for a gas turbine casing according to the present invention will be explained with reference to FIGS. 1 through 8.

Figure 1:
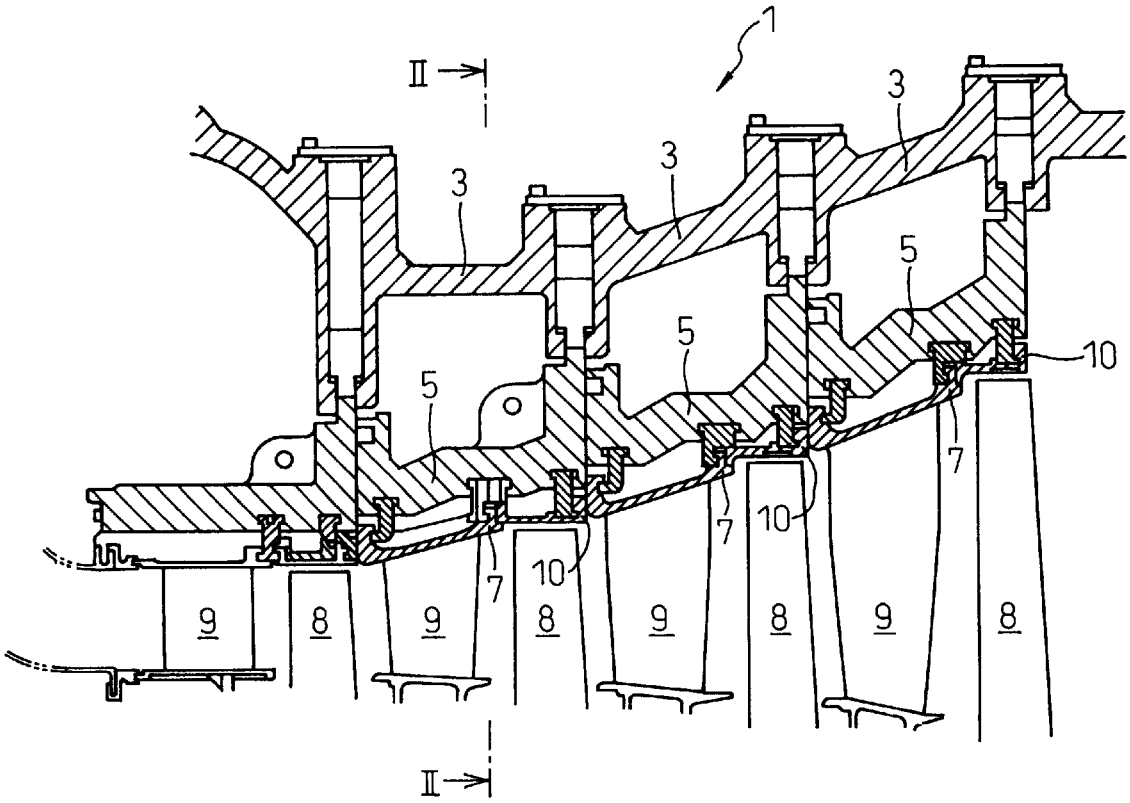
FIG. 1 is a longitudinal section view of a gas turbine casing showing the position of the split.

In the embodiments explained below, split rings 10 are disposed in the turbine casing as shown in FIG. 1.

Figure 2A:
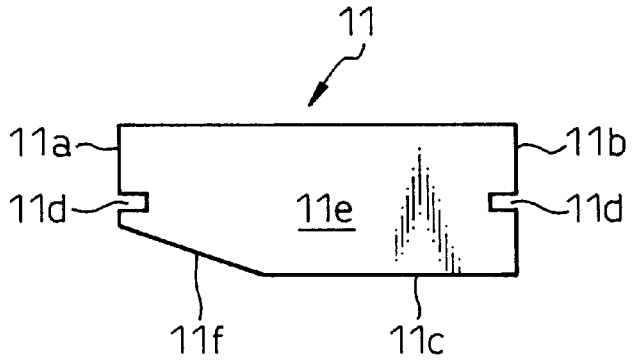
FIGS. 2A and 2B illustrate the shape of a split segment in a first embodiment of the split ring according to the present invention.
Figure 2B:
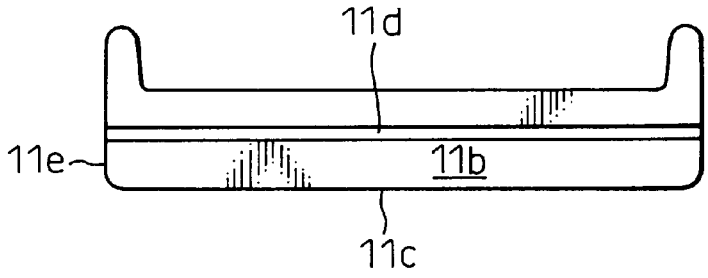

FIGS. 2A and 2B illustrate a split segment 11 composing the split ring 10 according to a first embodiment of the present invention. FIG. 2A shows an end face (an axial end face) of the split segment 11 viewed in the axial direction of the turbine (i.e., in the direction of the arrows II—II in FIG. 1). FIG. 2B shows an end face (a circumferential end face) of the split segment 11 viewed in the circumferential direction.

As shown in FIG. 2B, the cross section of the split segment 11 taken along the turbine axis is approximately U-shape, and a groove lid for fitting a seal plate is formed on each of the circumferential end faces 11*a* and 11*b* of the split segment 11.

FIG. 2A shows an axial end face lle located upstream side of the split segment 11 with respect to combustion gas flow. As shown in FIG. 2A, one of the circumferential end faces of the split segment 11 (i.e., the end face 11*a* located on the upstream side with respect to the direction of rotation of the turbine rotor) is connected to the inner face 11*c* by a transition face 11*f*. The transition face 11*a* in this embodiment is formed as a plane having a relatively small inclination to the inner face 11*c* and connecting the inner face 11*c* to the upstream circumferential end face 11*a* at the portion near the fitting groove 11*d* for the seal plate.

Figure 3:
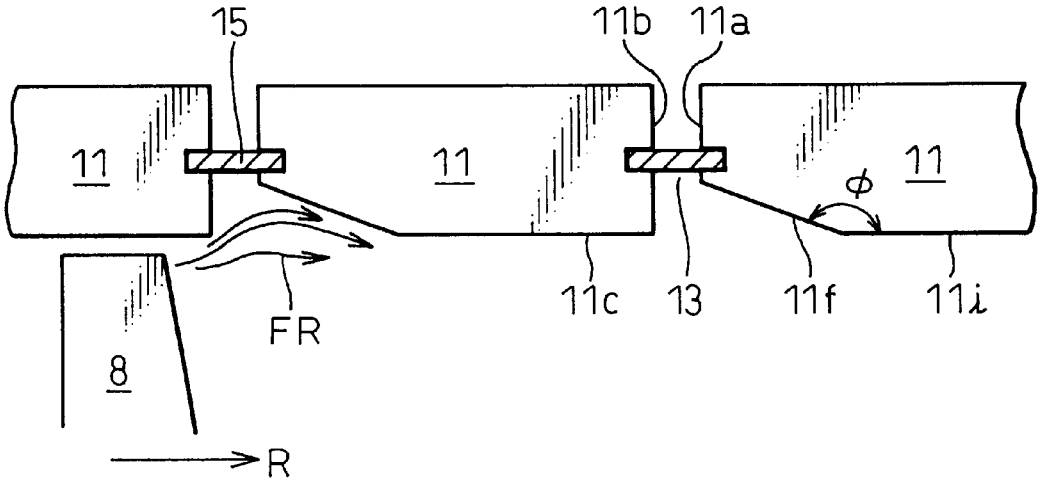
FIG. 3 schematically shows the arrangement of the split ring using the split segments in FIGS. 2A and 2B.

FIG. 3 shows a split ring obtained by assembling the split segments 11 in FIG. 2. As explained in FIG. 1, the split segments 11 are fitted to the thermal insulation ring 5 surrounding the turbine rotor blades 8 in such a manner that the upstream circumferential end face 11*a* of a split segment opposes the downstream circumferential end face 11*b* with a predetermined clearance 13 therebetween as shown in FIG. 3. Further, the split segments 11 are assembled with the seal plates 15 fitted to the groove 11*d*. The seal plate 15 has a function of preventing hot combustion gas from entering the space behind the split segment 11.

In this embodiment, the transition face 11*f*, i.e., the inclined plane surface is located on the upstream side of the split segment 11 with respect to the direction of rotation of the rotor blades (indicated by R in FIG. 3).

Figure 10:
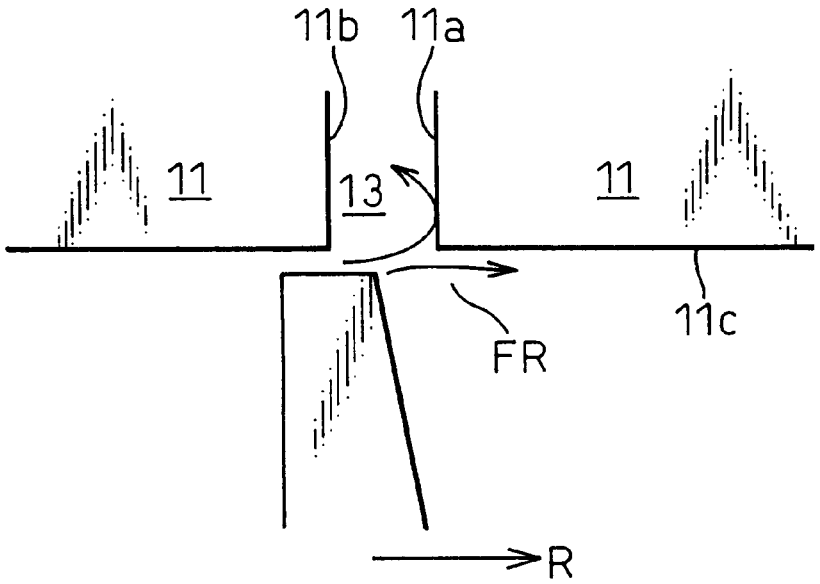
Fig. 10 RELATED ART

When the gas turbine is in operation, the swirl flow FR of the combustion gas enters into the clearance 13 between the split segments as explained in FIG. 10 in this embodiment. However, since the transition face formed as inclined plane

11*f* is provided between the upstream end face 11*a* and the inner face 11*c* in this embodiment, the swirl flow FR flows along the transition face 11 without impinging the upstream end face 11*a*. Therefore, the increase in the local heat transfer rate due to the impingement of the combustion gas does not occur in this embodiment.

It is preferable to set the inclination of the transition face 11*f* as small as possible (i.e., the angle Φ in FIG. 3 as large as possible) in order to guide combustion gas along the transition face smoothly and, thereby, to prevent a sharp increase in the local heat transfer rate.

However, if the inclination of the transition face 11*f* is small, the length of the transition face 11*f* becomes long. Since the clearance between the surface of the transition face 11*f* and the tips of the rotor blades is larger than the clearance between the inner face 11*c* and tips of the rotor blades, the amount of combustion gas flow through the clearance in axial direction, i.e., an amount of leak loss, increases. This causes the efficiency of the turbine to decrease. Therefore, the local temperature rise of the end face of the split segment (i.e., the length of the transition face) and the turbine efficiency have trade-off relationship and an optimum value for the inclination of the transition face 11*f* is preferably determined, through experiment, by considering the actual operating condition of the gas turbine.

Next, a second embodiment of the present invention will be explained.

Figure 4:
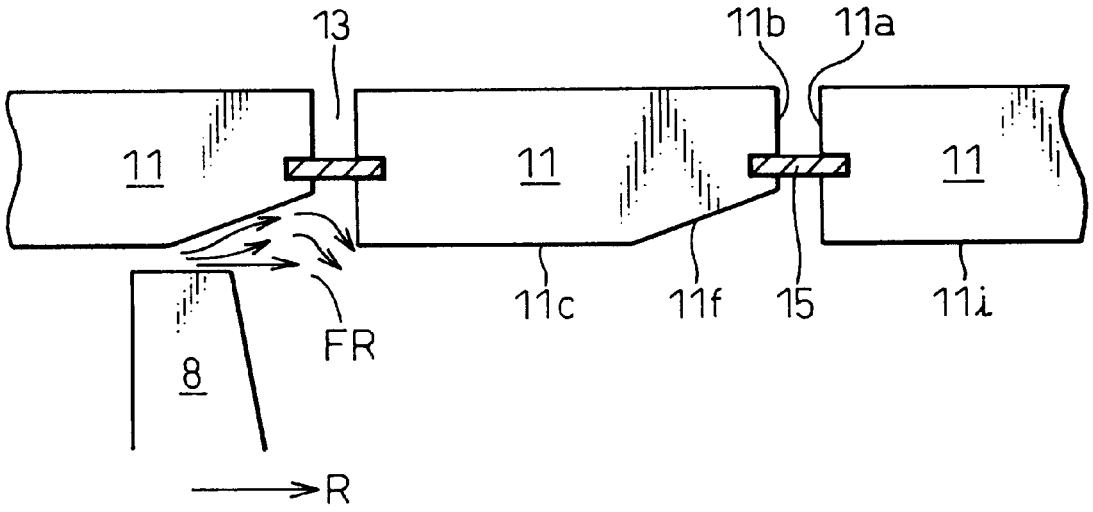
FIG. 4 is a drawing similar to FIG. 3 showing a second embodiment of the split ring according to the present invention.

FIG. 4 is a drawing similar to FIG. 3 and explains a second embodiment of the present invention. In FIG. 4, reference numerals the same as those in FIGS. 2 and 3 indicate elements similar to those in FIGS. 2 and 3.

This embodiment is difference from the embodiment in that the transition face 11*f* (i.e., inclined plane) is located on the corner between the inner face 11*c* and downstream end face 11*b* of the split segment 11.

In this embodiment, when the rotor blades 8 approaches the downstream end face 11*b* during the turbine operation, the clearance between the tips of the rotor blades 8 and the transition face 11*f* increases as the blade tips approach the downstream end face 11*b*. Therefore, the flow path of the swirl of combustion gas diverges as the flow FR approaches the downstream end face 11*a* of the split segment 11. This causes the velocity of the swirl flow to decrease as it approaches the clearance 13 between the split segments 11. Therefore, though the swirl flow impinges on the upstream end face 11*a* after it enters the clearance 13, the velocity at which the swirl flow hits the end face 11*a* becomes substantially lower compared with that in the case where the transition face 11*f* is not provided. Since the velocity of the swirl flow FR when it hits the upstream end face 11*a* is low, the sharp increase in the heat transfer rate due to the impingement is suppressed and the sharp rise in the temperature of the upstream end face 11*a* is small in this embodiment.

Figure 5:
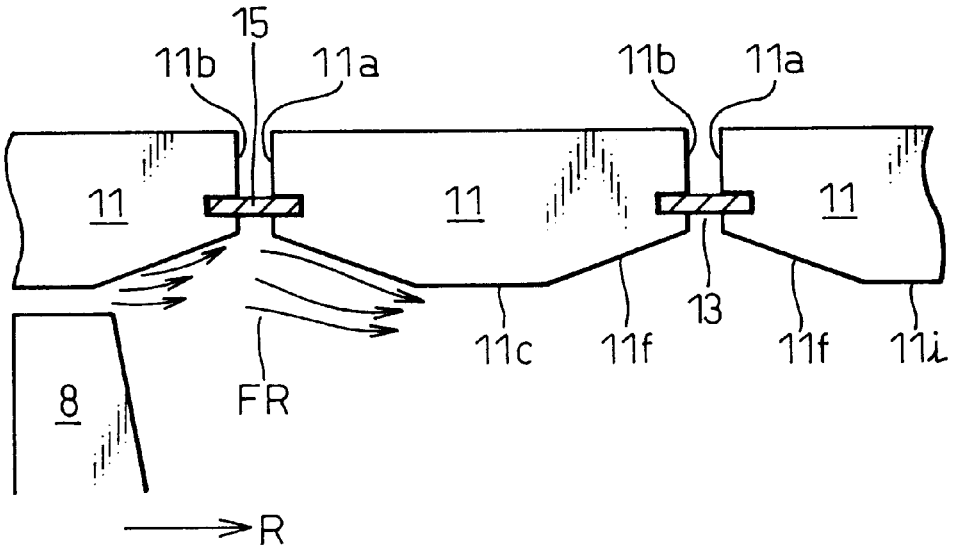
FIG. 5 is a drawing similar to FIG. 3 showing a third embodiment of the split ring according to the present invention.

FIG. 5 is a drawing similar to FIG. 3 and explains a third embodiment of the present invention. In FIG. 5, reference numerals the same as those in FIGS. 2 and 3 indicate elements similar to those in FIGS. 2 and 3.

In this embodiment, as shown in FIG. 5, transition faces 11*f* similar to those in FIGS. 3 and 4 are formed on both upstream and downstream end faces 11*a* and 11*b*. Thus, the swirl flow of combustion gas FR is decelerated before it flows into the clearance 13 between the split segments 11 and flows along the transition face 11*f* located upstream side of the split segment 11 without impinging the upstream end face 11*a*. Therefore, the local temperature rise at the upstream end face 11*a* is very small in this embodiment.

Figure 6:
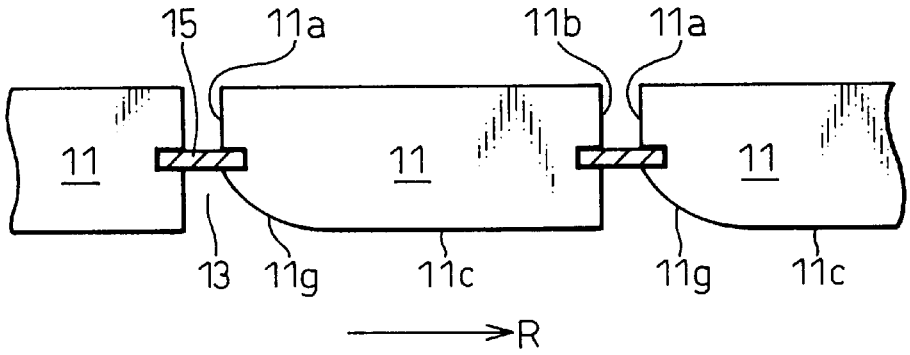
FIG. 6 is a drawing similar to FIG. 3 showing a fourth embodiment of the split ring according to the present invention.
Figure 7:
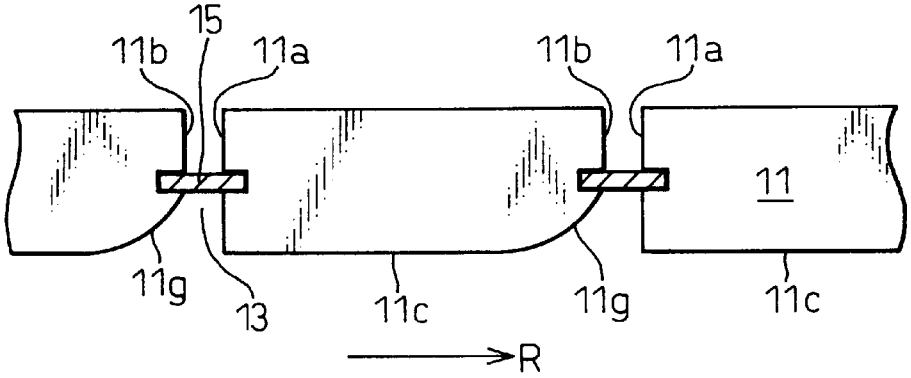
FIG. 7 is a drawing similar to FIG. 3 showing a fifth embodiment of the split ring according to the present invention.
Figure 8:
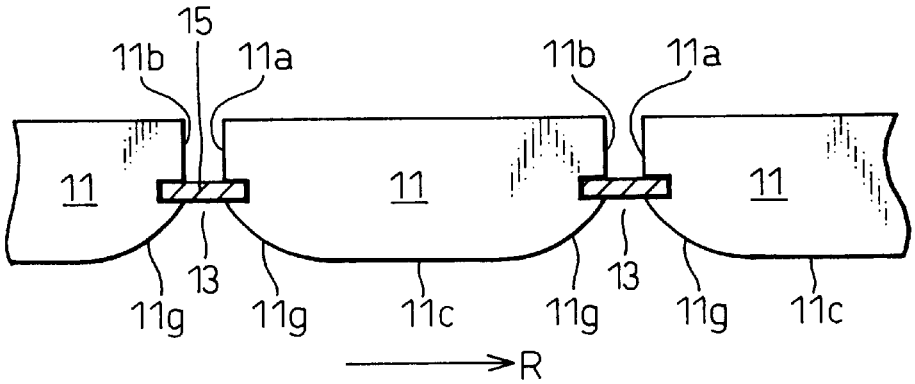
FIG. 8 is a drawing similar to FIG. 3 showing a sixth embodiment of the split ring according to the present invention.
Figure 9:
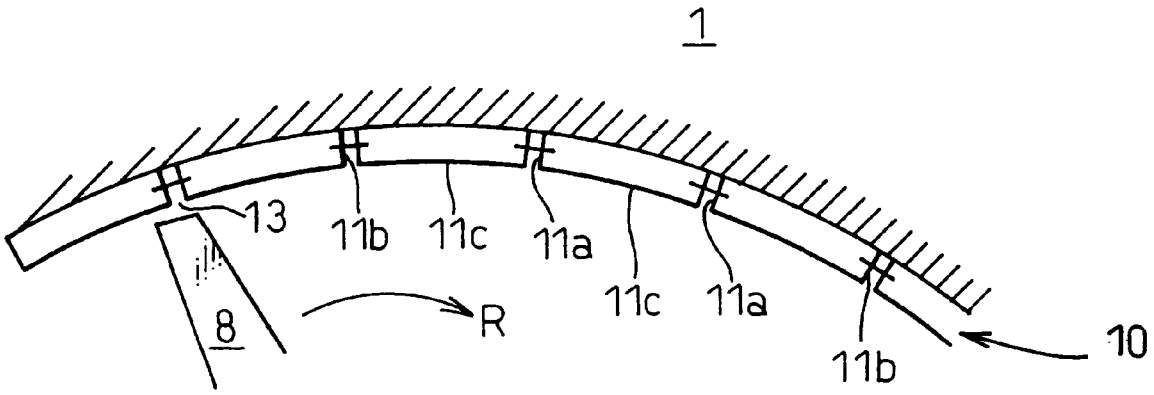
Fig. 9 RELATED ART
FIGS. 9 and 10 illustrate the problems in the split ring in the related art.

FIGS. 6 through 8 show fourth to sixth embodiments of the present invention. In the first to third embodiments, transition face 11*f* is formed as inclined plane. The fourth to sixth embodiments are different from the previous embodiments in that the transition face 11*g* formed as a curved surface instead of an inclined plane. In FIGS. 6 through 8, the transition face 11*g* is formed as a cylindrical surface having a center axis parallel to the center axis of the turbine rotor. However, a spherical surface, instead of a cylindrical surface, may be used as the transition face.

In FIGS. 6 through 8, the transition face 11*f* having a cylindrical surface smoothly connects the inner face 11*c* and the upstream and/or downstream end face. Therefore, similarly to the first to third embodiments, the local temperature rise due to the impingement of the swirl of combustion gas can be effectively suppressed. Further, since the inner face 11*c* and the end face 11*a* and/or 11*b* are connected by a curved surface, a sharp corner where a crack due to the concentration of thermal stress may occur is eliminated according to these embodiments.

The transition face 11*g* having curved surface (in FIGS. 6 through 8, cylindrical surfaces) can be disposed on the upstream side end face 11*a* (FIG. 6) of the split segment 11 or on the downstream side end face 11*b* (FIG. 7) of the split segment, or on both of the end faces (FIG. 8). In the fourth to sixth embodiments, the size (the radius) of the cylindrical surface is preferably determined, by experiment, after considering the operating conditions of the gas turbine.

What is claimed is:

1. A split ring for a gas turbine casing comprising a plurality of split segments arranged on an inner wall of the gas turbine casing in a circumferential direction at predetermined intervals so that the split segments form a ring disposed between tips of turbine blades and the inner wall opposing the tips of the turbine blades, wherein each of the split segments includes two circumferential end faces which oppose the end faces of the adjacent split segments and an inner face substantially perpendicular to the end faces and opposing the tips of the turbine blades and a transition face formed between at least one of the end faces and the inner face and, wherein the surface of the transition face is formed in such a manner that the clearance between the tips of the turbine blades and the surface of the transition face increases from the inner face toward the end face, wherein one transition face is formed on each split segment between the inner face and the end face located on the downstream side of the split segment with respect to the direction of rotation of the turbine blades.

2. A split ring for a gas turbine casing comprising a plurality of split segments arranged on an inner wall of the gas turbine casing in a circumferential direction at predetermined intervals so that the split segments form a ring disposed between tips of turbine blades and the inner wall opposing the tips of the turbine blades, wherein each of the split segments includes two circumferential end faces which oppose the end faces of the adjacent split segments and an inner face substantially perpendicular to the end faces and opposing the tips of the turbine blades and a transition face formed between at least one of the end faces and the inner face and, wherein the surface of the transition face is formed in such a manner that the clearance between the tips of the turbine blades and the surface of the transition face increases from the inner face toward the end face, wherein two transition faces are formed on each split segment between the inner face and both end faces of the split segments.

3. A split ring for a gas turbine casing comprising a plurality of split segments arranged on an inner wall of the gas turbine casing in a circumferential direction at predetermined intervals so that the split segments form a ring disposed between tips of turbine blades and the inner wall opposing the tips of the turbine blades, wherein each of the split segments includes two circumferential end faces which oppose the end faces of the adjacent split segments and an inner face substantially perpendicular to the end faces and opposing the tips of the turbine blades and a transition face formed between at least one of the end faces and the inner face and, wherein the surface of the transition face is formed in such a manner that the clearance between the tips of the turbine blades and the surface of the transition face increases from the inner face toward the end face, wherein the surface of the transition face is formed as a cylindrical or spherical surface continuous with both the inner face and the end face of the split segment.

4. A split ring for a gas turbine casing as set forth in claim 3, wherein one transition face is formed on each split segment between the inner face and the end face located on the upstream side of the split segment with respect to the direction of rotation of the turbine blades.

5. A split ring for a gas turbine casing as set forth in claim 3, wherein one transition face is formed on each split segment between the inner face and the end face located on the downstream side of the split segment with respect to the direction of rotation of the turbine blades.

6. A split ring for a gas turbine casing as set forth in claim 3, wherein two transition faces are formed on each split segment between the inner face and both end faces of the split segment.

* * * * *